United States Patent [19]

Browne

[11] Patent Number: 4,577,427

[45] Date of Patent: Mar. 25, 1986

[54] DISPLAY

[75] Inventor: John Browne, Georgetown, Canada

[73] Assignee: Nei Canada Limited, Toronto, Canada

[21] Appl. No.: 609,749

[22] Filed: May 14, 1984

[51] Int. Cl.[4] ..... G09F 9/00

[52] U.S. Cl. ..... 40/449; 340/815.05; 340/815.27

[58] Field of Search ..... 40/449, 447, 450, 492; 340/815.27, 815.26, 815.04, 815.05

[56] References Cited

U.S. PATENT DOCUMENTS

| | | | |
|---|---|---|---|
| 3,140,553 | 7/1964 | Taylor | 40/449 |
| 3,295,238 | 1/1967 | Winrow | 40/449 |
| 3,942,274 | 3/1976 | Winrow | 40/449 |
| 4,178,575 | 12/1979 | Ono | 340/764 |
| 4,383,255 | 5/1983 | Grandjean et al. | 340/815.27 |

FOREIGN PATENT DOCUMENTS

| | | | |
|---|---|---|---|
| 771356 | 11/1967 | Canada | 40/449 |

*Primary Examiner*—Robert Peshock
*Assistant Examiner*—Cary E. Stone

[57] ABSTRACT

A magnet operated display or indicator device selectably displays one of two faces of a disk. The disk is stopped in each limiting position by a stop contacting the disk inboard of its edge to another aspect the magnet is offset relative to the pivot axis of the disc to give better starting torques. In another aspect, where a plurality of disks are in columns, the pivot axes are stepped to be parallel but not coaxial.

7 Claims, 5 Drawing Figures

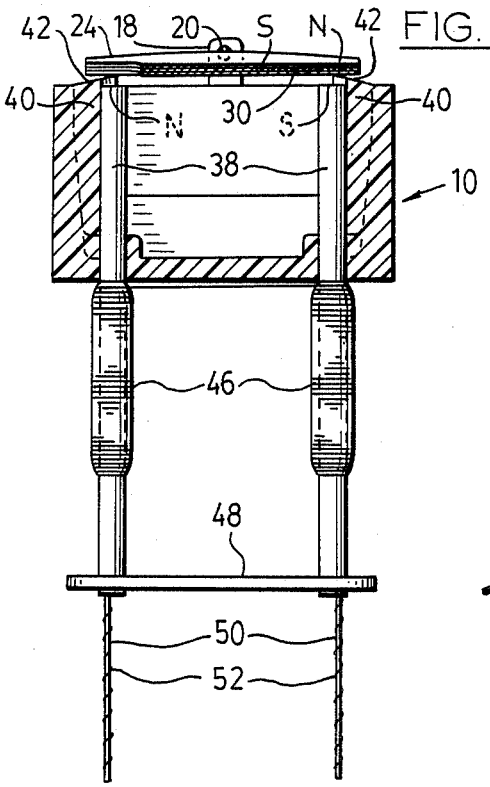
FIG. 2
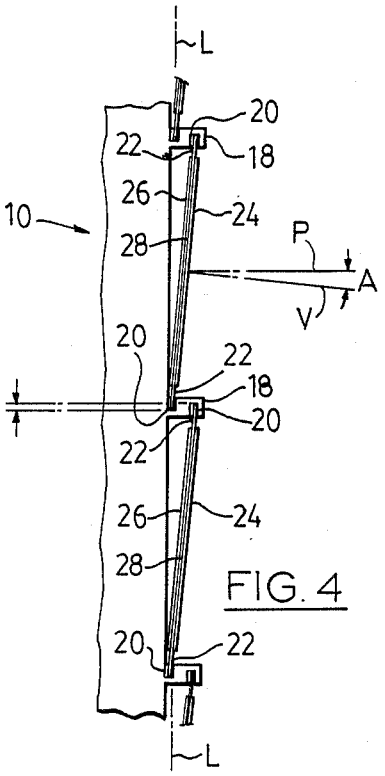
FIG. 4
FIG. 3
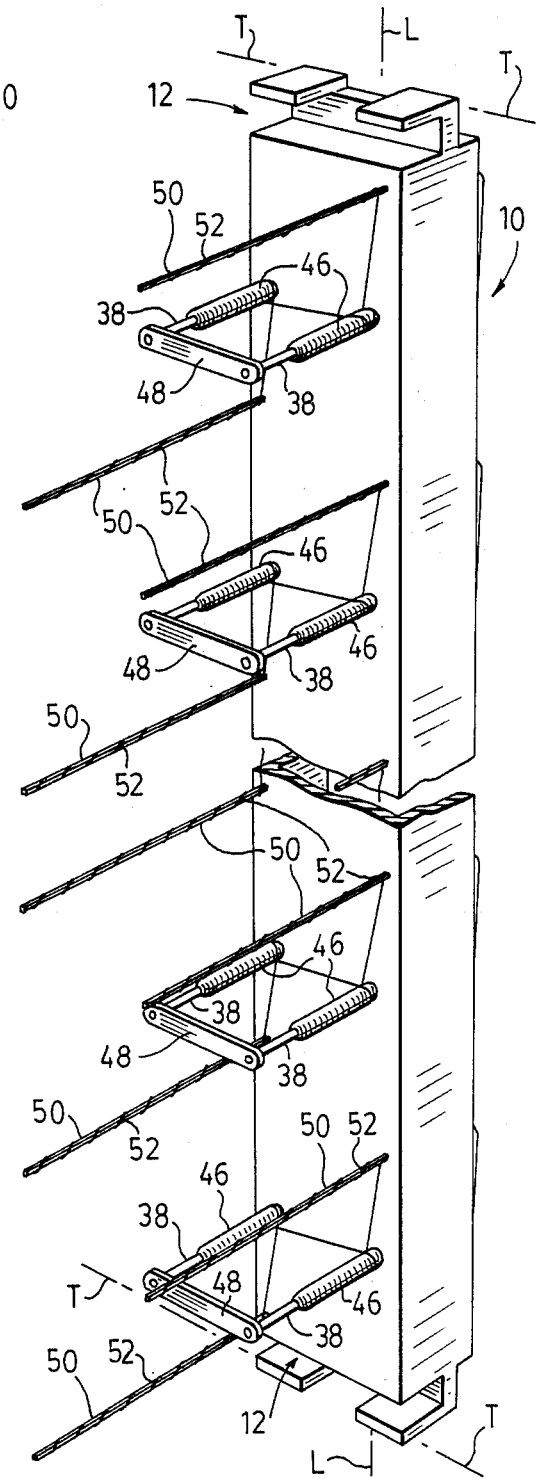

DISPLAY

This invention relates to a device for use in electromagnetic displays or indicators.

BACKGROUND OF INVENTION

The type of device with which this invention is concerned has disks pivotally mounted in approximately their median plane, contrastingly colored on opposite sides and carrying a permanent magnet having an axis with a component transverse to the pivot axis. A selectably reversible field forming means external to the disk controls the orientation of the disk by the influence of the field on the permanent magnet and causes it to display one or the other of its contrasting faces in the viewing direction.

Such disks are frequently arranged in columns and, in such columns are frequently arranged in a single frame. To obtain greater visibility for the disks of the display, it is sometimes desireable to make the disk oval instead of circular with its long dimension corresponding generally to the longitudinal direction of the column of the array. If the pivot axis is then directed in the column direction so that the pivot axes of all the disks in a column are coaxial, then the disk spindles and the spindle wells for the disks require space between adjacent disks in the column and such space detracts from the appearance of the display since it decreases the area of the display which may be reversed in appearance.

SUMMARY OF INVENTION

Accordingly, in one aspect of the invention, the spindle wells for adjacent disks in a column are provided in overlapping arrangement (that is wells displaced laterally from each other relative to the row direction) so that the frame mount between two adjacent disks contains overlapping wells opening in opposite directions for the pivot spindles of the disks on each side of the frame mount. The axes of the disks in a column, although still substantially parallel are no longer coaxial, the axes being stepped from each other by roughly the spacing of the overlapping spindle wells. There is therefore a small angle between the axis of the disks and the plane of the display. In this way the disks may be brought closer together in the column direction reducing the unused (by contrasting surfaces) area of the display.

In preferred applications of the arrangement discussed in the previous paragraph, the row of disks is arranged vertically. In such orientation, the display usually being viewed at an angle below the normal to the sign, the disks are, in such event, oriented so that the normal to the disks slopes downwardly at an angle to improve the appearance to the normally placed viewer.

It may be suitable here to discuss the criteria for the change of angle of the axis to the longitudinal row direction. The upper limit for such angle will be set by the requirement to provide a suitable viewing angle. It is difficult to visualize situations where this angle would be greater than 1O° and for most applications 5° will be the upper limit. In the preferred method of making the device the spindle wells will be formed in the molded plastic frame. The minimum angle between the disk axes and the plane of the display will be controlled by the minimum thickness dimension between the two bearing wells which can suitably be molded in plastic. This sets the minimum angle of the spindles to the row axis at about 3° and it will be difficult to obtain the required separating wall thickness with the angle appreciably smaller. However, it must be realized that the 3° and 1O° cannot be regarded as absolute limits since the angle between the disk axis and the column direction will change with each disk size.

In many applications including, in particular, bus destination signs, there is ample room for the height of the display but very limited available width. Accordingly, in order to increase the visibility of such signs, it is desireable to increase the height of the display without altering the width. It will then be desireable to increase the disk in the corresponding dimension. With the nearly vertical slightly sloping disk axes, the disks are then made oval shaped and symmetrical about the disk axis (with the exception of a notch as hereafter described) and the long dimension of the oval along the disk axis. The result is an array extended in the height dimension.

In another aspect of the invention, the magnetic field forming members, exterior to the disk, have magnetic cores energized by windings, with the forward core ends just rearward of the plane of the disk in each orientation of the latter. One edge of the disk is therefore notched to allow the disk to pass the core end and any associated support in rotating from one orientation to the opposite orientation. The permanent magnet is preferably contained in the plane of the disc. The magnet defining a magnetic axis transverse to the pivot axis, is displaced transversely to the pivot axis, away from the notch, so that the outer pole of the magnet is adjacent one of the core ends in each orientation of the disc. (With such preferred assymetric disposition of the magnet the inner pole of the magnet has almost no effect on the operation). Means are provided adjacent each pole piece for stopping the rotation of the disc inward of the edge to avoid irregularities which sometimes occur on such edge. The spacing is also provided to avoid magnetic switching of the core polarity due to the close proximity to the permanent magnet.

In another aspect of the invention, the magnetic field forming members, exterior to the disk, have magnetic cores energized by windings, with the forward ends of the cores just rearward of the plane of the disk in each orientation of the latter. One edge of the disk is therefore notched to allow the disk to pass the core end and any associated support in rotating from one orientation to the opposite. The permanent magnet is preferably contained in the plane of the disk. The magnet defining a magnetic axis transverse to the pivot axis, is displaced transversely to the pivot axis, away from the notch. The outer edge of the permanent magnet is located within a truncated 45° cone whose axis is perpendicular to the rest position of the disk and which cone enlarges from the core end toward the disk. This location of the outer end of the permanent magnet ensures good starting torque for the disk when the core is reversed to reverse the orientation. It will be noted that the design is such that the above defined geometrical relationship will be true for whichever core end is located near the outer end of the assymetrically disposed magnet. The good starting torque avoids the necessity of an extra bias magnet of the type required in the design shown in U.S. Pat. No. 3,518,664 dated June 30, 1970 to M. K. Taylor.

It should be clearly noted that in connection with the aspect of the invention just mentioned and with that aspect where the contact stop for the disk is inboard of its edge, the advantages apply to single disk indicators (often known as status indicators) and in these aspects, therefore the invention is not limited to use with a plurality of disks in a column. It should also be noted that the last mentioned two aspects apply to a disk whose pivotal axis is not slanted.

In the preferred form of the invention the disk is of the type disclosed in U.S. Pat. Nos. 3,871,945 dated Mar. 18, 1975 and (its divisional) 3,953,274 dated April 27, 1976, both naming as inventors Winrow et al. The disk is thus made of 3 layers laminated together, the middle layer is apertured in the shape of and to receive a magnet of approximately the thickness of such middle layers. It will be obvious that this method of construction allows the preferred assymetric disposition of the magnet to the extent desired without inconvenience since the middle layer is merely punched at the selected location and the magnet inserted during the construction of the disk. In the patented construction, moreover, the middle layer is shaped to provide projecting spindles which form the mounting spindles of the disk. (It should be noted that each of the outer layers is usually two sub-layers. The outer layer corresponding to the dark side is usually a sub-layer of mylar with a sub-layer of dark tape thereover to produce the dark outer surface on the ultimate disk. The opposite side of the disk will customarily have a sub-layer of vinyl colored to the bright color required, and sub-layer being an outer transparent protective casing. In general however the disk is assembled as a three layer lamination, the myler-dark covered sub-layers being applied as a single layer to one side of the central layer and the vinyl-protective covering sub-layers being applied as a single layer to the other side of the central layer.

Although the inventive aspects defined herein are suited to the previously patented laminar disk, it must be emphasized that in the broad aspects of the invention, including the aspect of tilting the disk axes relative to the row axes and the aspect of stopping the disk with a contact inward of the disk edge are not limited to use of the patented disk.

PREFERRED EMBODIMENT

In drawings which illustrate the preferred embodiment of the invention:

FIG. 2 is a sectional view taken along the lines 2—2 of FIG. 1;

FIG. 3 is a rear view of the row of disks of FIG. 1;

FIG. 4 is a vertical section in a plane parallel to the viewing direction.

In the drawings:

Figure 1:
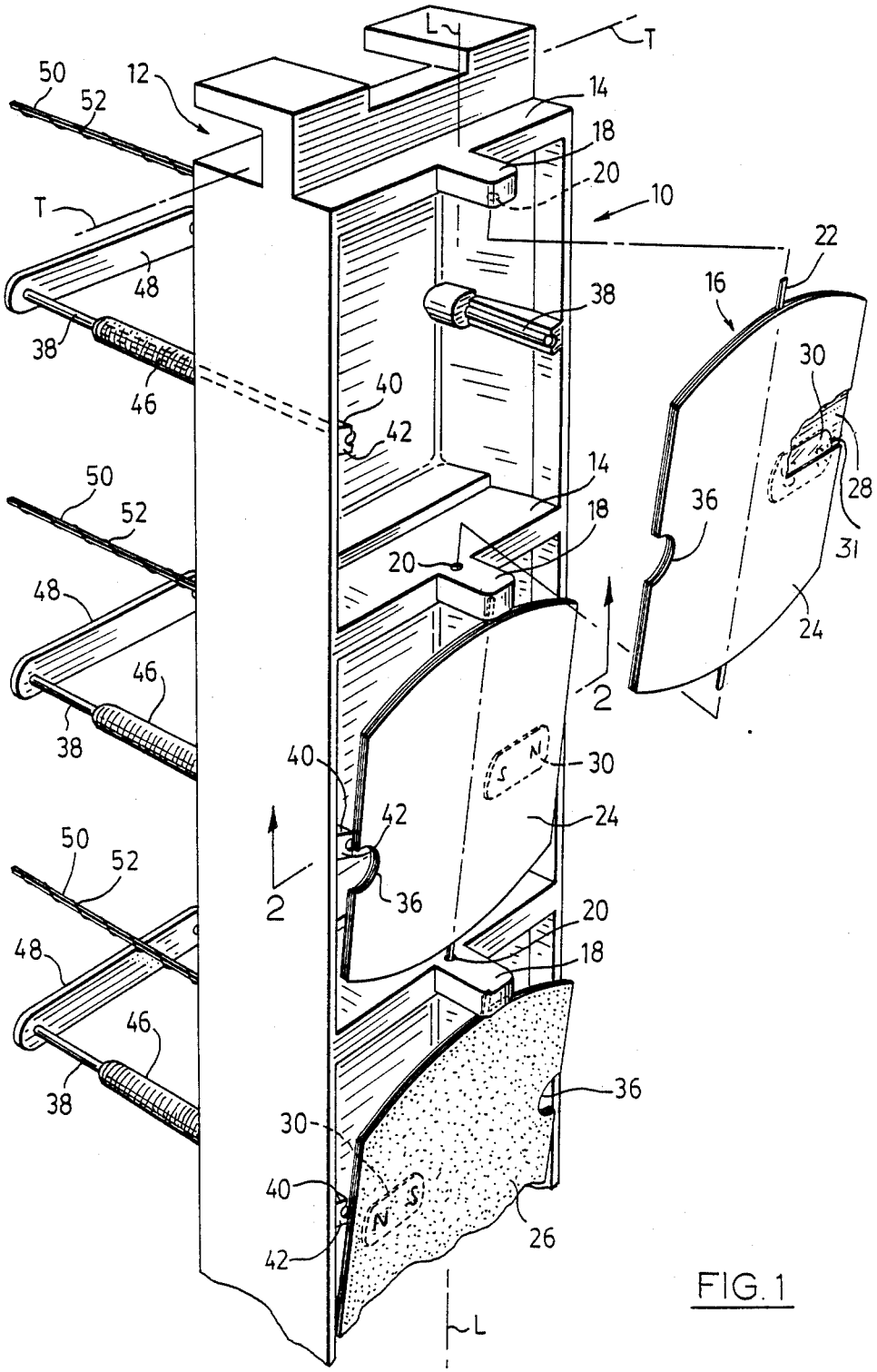
FIG. 1 is a perspective and partially exploded view of a part of a row of disks in accord with the invention.

FIG. 1 shows the frame 10 running longitudinally along direction L and such frame at each end, in the preferred embodiment, is provided with means defining mounting grooves 12 which allow a plurality of frames 10 to be mounted side by side on transverse coupling members received in grooves 12, to form an array. The transverse direction is indicated by lines T—T. An analogous method of mounting longitudinally extending display frames is shown in U.S. Pat. No. ',942,274 dated Mar. 9, 1976 to Winrow although, in that patent, the transverse grooves are forwardly directed.

It will be understood that the directions L, T define a display plane in such a device and that the usual viewing direction V is tilted downwardly from the perpendicular P to such plane.

In the drawings the frame defines transverse walls 14 at each end and located between adjacent ones of the longitudinally disposed disks 16. Each transverse wall 14 is provided with a forwardly directed mounting projection 18. Adjacent mounting projections 18 are provided with facing wells 20 to received the disk 16 spindles 22. As best shown in FIG. 4 the facing wells 20 of adjacent projections 20 are displaced in the forward direction to tilt the disk pivot axis to the vertical a sufficient degree so that the wells 20 on opposite sides of a projection 18 overlap in a vertical direction (that is are laterally displaced from each other relative to the row direction). The wells, as previously explained will normally be displaced to produce an angle A of the spindle axes to the vertical of about 3°.

The disk 14, preferably constructed as defined in U.S. Pat. Nos. 3,871,945 and 3,953,274, previously referred to, comprises a lamination of three layers. Each of the two outer layers 24 and 26 are usually made from two sub-layers. The light side layer 24 is usually an inner sub-layer of vinyl colored for the light color designed with an outer transparent protective sub-layer. The dark side layer 26 is usually an inner sub-layer of mylar with an outer sub-layer of tape to provide the dark color. The middle layer 28 is preferably of mylar to correspond to that of the magnet 30. The mylar layer has sufficient strength that it supports the extending stud shafts 22 which are formed as an integral part of the middle layer. The stub shafts 22 may be inserted in wells 20 by slightly bending the resilient (due to the resiliency of the mylar) disk to achieve insertion.

As best shown in FIG. 1 the middle layer 28 is provided with a slot shaped to receive the permanent magnet 30 which is preferably made of the copper-nickel-iron alloy cunife magnetized to provide a magnetic axis in the median plane of the disk transverse to the pivot axis defined by spindles 20. The poles 'N' and 'S' of the permanent magnet are shown in the drawings.

The middle layer 28 of the disk is recessed and the magnet is located so that it is displaced to be all on one side of the pivotal axis at about the midway point between the stubs 22. On the edge opposite the assymetric displacement direction of the magnet is provided a notch 36 for a purpose to be hereafter discussed.

The disk is preferably made longer than it is wide to take advantage of the fact that in many applications, such as bus signs, there is more available space in the vertical than in the horizontal dimension so that the height of the disks is increased to give greater visibility.

The shape of the disk is a compromise. An oval disk terminating in semicircles at each end would give a better visual impression than a rectangle for disks collectively defining a diagonal. However, the oval disk does not use as much of the available display area as desired. Therefore, the compromise shape with curved end and corners as shown is used.

As noted the use of overlapping wells and angled spindles allows more complete use of the available display space in a row by allowing the disks to be placed more closely together.

Actuation for the disk to turn it to one or the other orientation is provided by a reversible magnetic field forming means, exterior to the disk and acting on the permanent magnet 30. The exterior field forming means in the preferred embodiment is provided by a pair of core members 38 of high carbon, steel, having a relatively high remanence. The core members 38 are fixed in position on each side of the frame and extend through bores therein to project rearwardly of the frame, as shown and forwardly to the vicinity of the disk (and magnet) locus when the disk is displaying one or the other of its contrasting sides in the viewing direction. The molded plastic frame provides on each side inwardly facing abutments 40 each of which partially surrounds a core 38 adjacent the core forward end. As shown in FIG. 2 the forward end of each abutment 40 has a forwardly and inwardly sloping surface 42 which is located forward of the forward end of core member 38 and shaped to contact the disk 16 inwardly of its edge.

The contact is made inwardly of the disk 16 edge because the construction of the disk sometimes leaves a small (not visible) accretion of adhesive or tacky material at the edge. The inwardly displaced contact does not contact such material and the risk of the disk sticking is therefore reduced.

The surface 42 stops the disk at a limiting position which is a location spaced from the core 38 end because it is preferred to use high carbon steel for the pole pieces. This material, although of relatively high remanence is of lower remanence than some core materials (such as vicalloy) previously used in controlling display disks. With the high carbon steel cores 38, therefore, care must be taken that the spacing between the ends of cores 38 and the permanent magnet 30 of the disk is such that the permanent magnet cannot alter the magnetic polarization of the core 38 and to cause latching of the disk. Accordingly, surface 42 is shaped to achieve the desired spacing which will be determined in accord with the cores 38 and magnet 30 used.

The disk opposite magnet 30 is provided with the notch 36 shaped to clear core 38 and abutment 40 during rotation of the disk.

Cores 38 project rearwardly of the frame and mount energizing windings 46 which magnetize the cores in the desired polarity. The bridging member 48 of iron having soft magnetic qualities is attached to the cores 38 rearwardly of windings 46 to complete the magnetic circuit between the cores 38. Terminal posts 50 are mounted to project rearwardly from the frame corresponding to each core 38 and designed at their rearward end for connection to an electrical circuit, not shown. The leads 52 to the windings 46 are preferably soldered to terminal posts 50 at the latter's rearward end. The windings 46 are connected in series so that energization to the paired terminal posts will magnetize the paired cores 38 so that one core forward end is north and the other south. These polarities are simultaneously reversed to rotate the disk.

With the disk axes sloped, as shown in FIG. 4, the assymetric arrangement of the disk, as shown in FIG. 1, aids in the operation of the disk. As noted, with any of the disks, a notch is removed from one side and the magnet is displaced toward the other. The weight bias in favour of the magnet displacement side together with the axial tilt assists the disk to start to turn as soon as the core is reversed to release at from a limiting position. This renders operation of the disk more certain.

Figure 5:
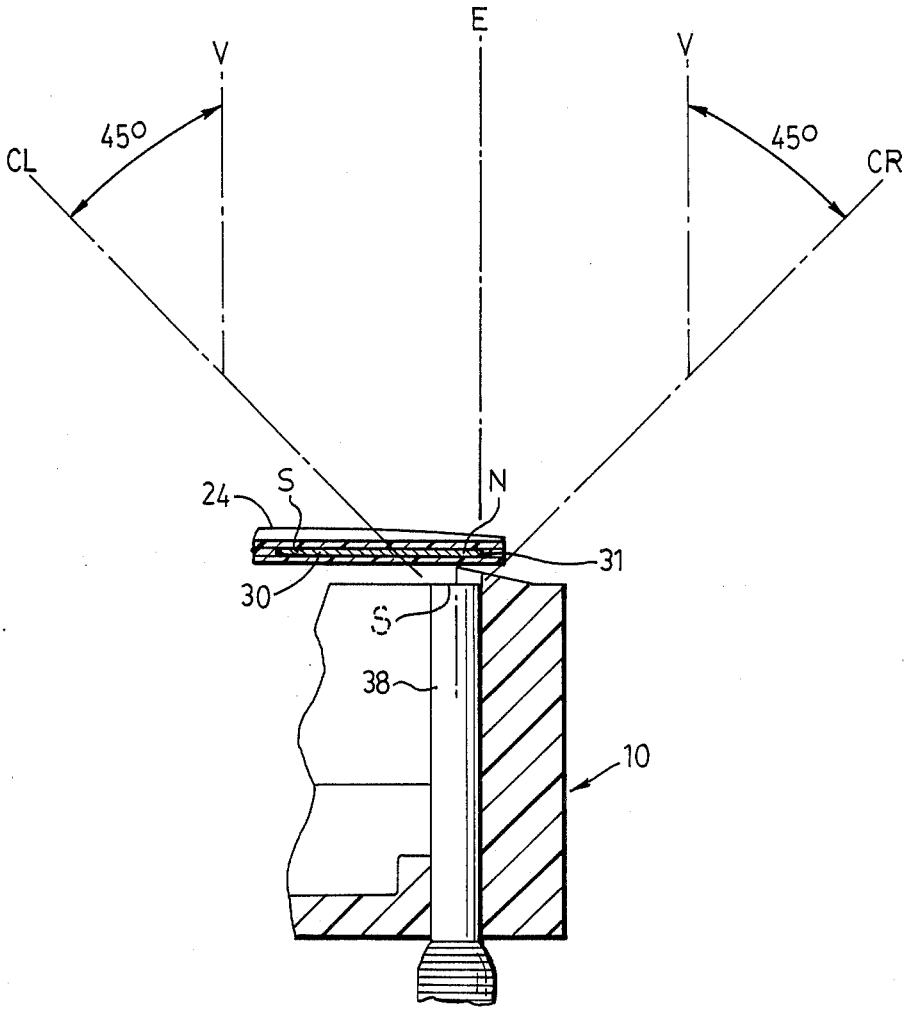
FIG. 5 is a partial cross-section of the device showing these elements which indicate the relationship of the permanent magnet outer edge to the core end.

As illustrated in FIG. 5 the permanent magnet 30, in its rest limiting position of FIG. 2 has its outer edge 31(corresponding to the N pole) within a 45° truncated core whose axis is perpendicular to the disk rest position and which expands from the core end in the direction of the disk. The location of the outermost edge 31 of the permanent magnet is indicated by the line E and the boundaries of the cone, as they appear in FIG. 5 are defined as CR and CL respectively. It will be obvious that the outer edge 31 of the permanent magnet is well within this cone. The practical result is that on reversal of the core magnetism the repulsive force from the core on the magnet is more nearly perpendicular to the disk than parallel, giving a good starting torque to the disk and avoiding the necessity of providing an extra bias magnet. The cores 38 are of course located so that the same effect occurs when the disk is in its opposite limiting position to that shown in FIG. 2, that is with the N end of the permanent magnet to the left and the notch to the right. Obviously the geometrical relationship will hold true where as shown the cores 38 are symmetrically disposed with respect to the pivotal axis.

As previously noted the feature of the invention just described, and that relating to the stop for the disk inboard of the disk apply to disks used singly as well as to a plurality of disks in rows; and both features apply to disks whether or not their pivotal axes are slanted.

In operation with the cores magnetized as indicated in FIG. 2 (by the dotted N and S) the disk would rotate (clockwise in FIG. 2) to, and remain in, the position there shown, corresponding to the middle disk of FIG. 1. When windings 46 are energized to reverse the polarities of the cores, the disk under the control of permanent magnet 30 will rotate (counterclockwise in FIG. 2) to and remain in the position there shown, corresponding to the middle disk of FIG. 1. When windings 46 are energized to reverse the polarities of the cores, the disk under the control of permanent magnet 30 will rotate (counterclockwise in FIG. 2) until the non-notched edge of the disk is resting on the left hand surface 42. The disk will then remain in that position until the cores are again switched.

In all aspects of the invention the polarity of the permanent magnet may be reversed and the operations and advantages will be the same, the positions of the disk being obtained by opposite magnetizations of the cores.

I claim:

1. Display or indicator device comprising: a plurality of pivotally mounted discs contrastingly coloured on opposite sides each carrying a permanent magnet defining a magnetic axis transverse to the pivot axis, magnetic field forming means exterior to the disc and arranged to provide a selectably reversible field causing rotation of the disc about the pivot axis to cause the display of one or of the other face of the disc in a predetermined viewing direction, characterized by:

a frame designed to pivotally mount a row of such discs, the pivotal axis for each element being substantially contained in a plane parallel to said viewing direction and parallel the longitudinal direction of said row, each said pivotal axis being inclined at substantially the same relative angle to the longitudinal direction of said row, said relative angle being of the order of 3°–10°.

2. Display or indicator as claimed in claim 1 wherein said disks are provided with pivot shafts extending from opposed ends of said disks for pivotal mounting in said frame, and said frame providing means between adjacent disks in a row defining bearing walls for the shafts of such adjacent disks, the bearing wells for adjacent disks being laterally displaced from each other relative to the row direction.

3. Display or indicating device as claimed in claim 2 wherein said disks are longer in the axial direction than in the direction transverse thereto.

4. Display or indicating device as claimed in claim 2 wherein the longitudinal direction of said row is substantially vertical and said magnet is assymetrically located relative to said pivotal axis and the disk is heavier on the side of the pivotal axis corresponding to the side where the magnet is closest to the disk edge.

5. Display or indicating device as claimed in claim 1 wherein said disks are longer in the axial direction than in the direction transverse thereto.

6. Display or indicating device as claimed in claim 1 wherein said disc is composed of three laminations and said magnet is dimensioned to be received in the middle laminated layer of the disc.

7. Display or indicating device as claimed in claim 1 wherein the longitudinal direction of said row is substantially vertical and said magnet is assymetrically located relative to said pivotal axis and the disk is heavier on the side of the pivotal axis corresponding to the side where the magnet is closest to the disk edge.

* * * * *